US011234506B2

(12) United States Patent
Mahoney et al.

(10) Patent No.: US 11,234,506 B2
(45) Date of Patent: Feb. 1, 2022

(54) MAKEUP APPLICATOR HAVING A WIPER WITH MULTIPLE WIPING ELEMENTS

(71) Applicant: L'Oreal, Paris (FR)

(72) Inventors: Zachary Mahoney, Freehold, NJ (US); Kyoo Jin Park, Leonia, NJ (US); Wenzhen Cheng, Annadale, NJ (US); Lemis Tarajano, Brooklyn, NY (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 16/863,696

(22) Filed: Apr. 30, 2020

(65) Prior Publication Data

US 2021/0337953 A1 Nov. 4, 2021

(51) Int. Cl.

| | |
|---|---|
| ***A46B 17/08*** | (2006.01) |
| ***A45D 40/26*** | (2006.01) |
| ***A46B 5/00*** | (2006.01) |
| ***A46B 9/02*** | (2006.01) |

(52) U.S. Cl.

CPC ..... *A45D 40/267* (2013.01); *A46B 5/0033* (2013.01); *A46B 9/021* (2013.01); *A45D 2200/10* (2013.01); *A46B 2200/1053* (2013.01)

(58) Field of Classification Search

CPC .. A45D 34/046; A45D 40/267; A46B 5/0033; A46B 9/021

USPC ..... 401/122

See application file for complete search history.

(56) References Cited

U.S. PATENT DOCUMENTS

| | | | | |
|---|---|---|---|---|
| 3,925,843 | A | 12/1975 | Tsuruzawa et al. | |
| 5,397,193 | A | 3/1995 | Kirk et al. | |
| 5,490,737 | A | 2/1996 | Gueret | |
| 5,716,150 | A | 2/1998 | Geuret | |
| 8,403,580 | B2 | 3/2013 | De Laforcade | |
| 8,690,466 | B2 * | 4/2014 | Von Jan | A45D 40/267 401/122 |
| 8,783,987 | B2 * | 7/2014 | Kulik | A45D 34/046 401/122 |
| 8,801,310 | B2 * | 8/2014 | Kulik | A45D 34/046 401/122 |
| 10,441,056 | B2 * | 10/2019 | Lefevre | A45D 40/267 |
| 10,448,725 | B2 * | 10/2019 | Weigel | A45D 34/046 |
| 10,548,386 | B2 * | 2/2020 | Chung | A45D 34/046 |

(Continued)

FOREIGN PATENT DOCUMENTS

| | | |
|---|---|---|
| EP | 0350535 A2 | 1/1990 |
| FR | 2837679 A1 | 10/2003 |

(Continued)

OTHER PUBLICATIONS

Preliminary Search Report dated Feb. 8, 2021, issued in French Application No. FR2006959, filed Jan. 7, 2020, 2 pages.

(Continued)

*Primary Examiner* — Jennifer C Chiang

(74) *Attorney, Agent, or Firm* — Christensen O'Connor Johnson Kindness PLLC

(57) ABSTRACT

A wiper for a cosmetic vial comprises a monolithic part having a cylindrical section and a cone section concentrically and sequentially arranged, wherein the cylindrical section and the cone section have a central interior hollow space along an axial center, and wherein the cylindrical and the cone sections are formed from stringers arranged into a lattice with openings extending from the interior to the exterior of the cylindrical section and the cone section.

12 Claims, 11 Drawing Sheets

(56) References Cited

U.S. PATENT DOCUMENTS

| | | | | |
|---|---|---|---|---|
| 2013/0101337 | A1* | 4/2013 | Kulik | A45D 40/268<br>401/122 |
| 2016/0000217 | A1 | 1/2016 | Chamberlain | |
| 2019/0335885 | A1 | 11/2019 | Castex | |

FOREIGN PATENT DOCUMENTS

| | | | |
|---|---|---|---|
| GB | 2483150 | A | 2/2021 |
| WO | 2012/093130 | A1 | 7/2012 |
| WO | 2018/115770 | A1 | 6/2018 |

OTHER PUBLICATIONS

Written Opinion dated Feb. 8, 2021, issued in French Application No. FR2006959, filed Jan. 7, 2020, 4 pages.

* cited by examiner

MAKEUP APPLICATOR HAVING A WIPER WITH MULTIPLE WIPING ELEMENTS

SUMMARY

Some cosmetics are applied by being loaded onto an applicator. In some cases, a vial contains a cosmetic, and an applicator is stored inside the vial until it is needed for applying a cosmetic. The applicator can also serve as a cap to seal the opening in the vial. The cap may also serve as the handle to grasp and control the applicator. The applicator can be withdrawn from the vial which comes out loaded with cosmetic ready for application. In withdrawing the applicator from the vial, it passes through wipers that might better distribute the cosmetic. The design of the wipers determine the distribution, quantity, and location of cosmetic on the applicator.

The present disclosure relates to providing a variety of wipers for a cosmetic vial. In an embodiment, a wiper for a cosmetic vial comprises a monolithic part having a cylindrical section and a cone section concentrically and sequentially arranged, wherein the cylindrical section and the cone section have a central interior hollow space along an axial center, and wherein the cylindrical and the cone sections are formed from stringers arranged into a lattice with openings extending from the interior to the exterior of the cylindrical section and the cone section.

In an embodiment, the wiper comprises a first flange on an end of the wiper.

In an embodiment, the wiper comprises a second flange at a junction between the cylindrical section and the cone section.

In an embodiment, the wiper comprises the exterior sides of the cone section bow inwardly.

In an embodiment, the monolithic part is an elastomer.

In an embodiment, the wiper comprises a cosmetic dispersed in the lattice.

In an embodiment, the cosmetic is mascara.

In an embodiment, a method of making a cosmetic wiper comprises building an elastomer monolithic part having a cylindrical section and a cone section concentrically and sequentially arranged by repeated deposition of an elastomer material layer, each layer is determined by a programmed model of the part.

In an embodiment, a cosmetic vial comprises the wiper inside of a vial, wherein a cosmetic is dispersed on the wiper; and an applicator is removably connected to the vial.

In an embodiment, the cosmetic is mascara.

In an embodiment, the applicator comprises brush bristles.

In an embodiment, the applicator rests within the hollow spaces of the cylindrical section and the cone section, and brush bristles on the applicator make contact with the wiper.

In an embodiment, a cosmetic vial comprises a plurality of the wipers, and an applicator is removably connected to the vial, wherein each one of the plurality of wipers is configured to fit within the vial.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

For applying cosmetic products through the use of applicators, the type of wiper coming into contact with the applicator is important. The wiper determines the distribution, quantity, and location of product on the applicator. As the applicator is extracted from the vial, the wiper cleans the applicator. Due to current limitations on molding technology wiping elements in cosmetic products circumscribe to flat protrusions of different materials. The present invention allows for multiple wiping shapes that result in new makeup looks and new sensorial experiences upon extraction of the applicator through the wiper.

Figure 1:
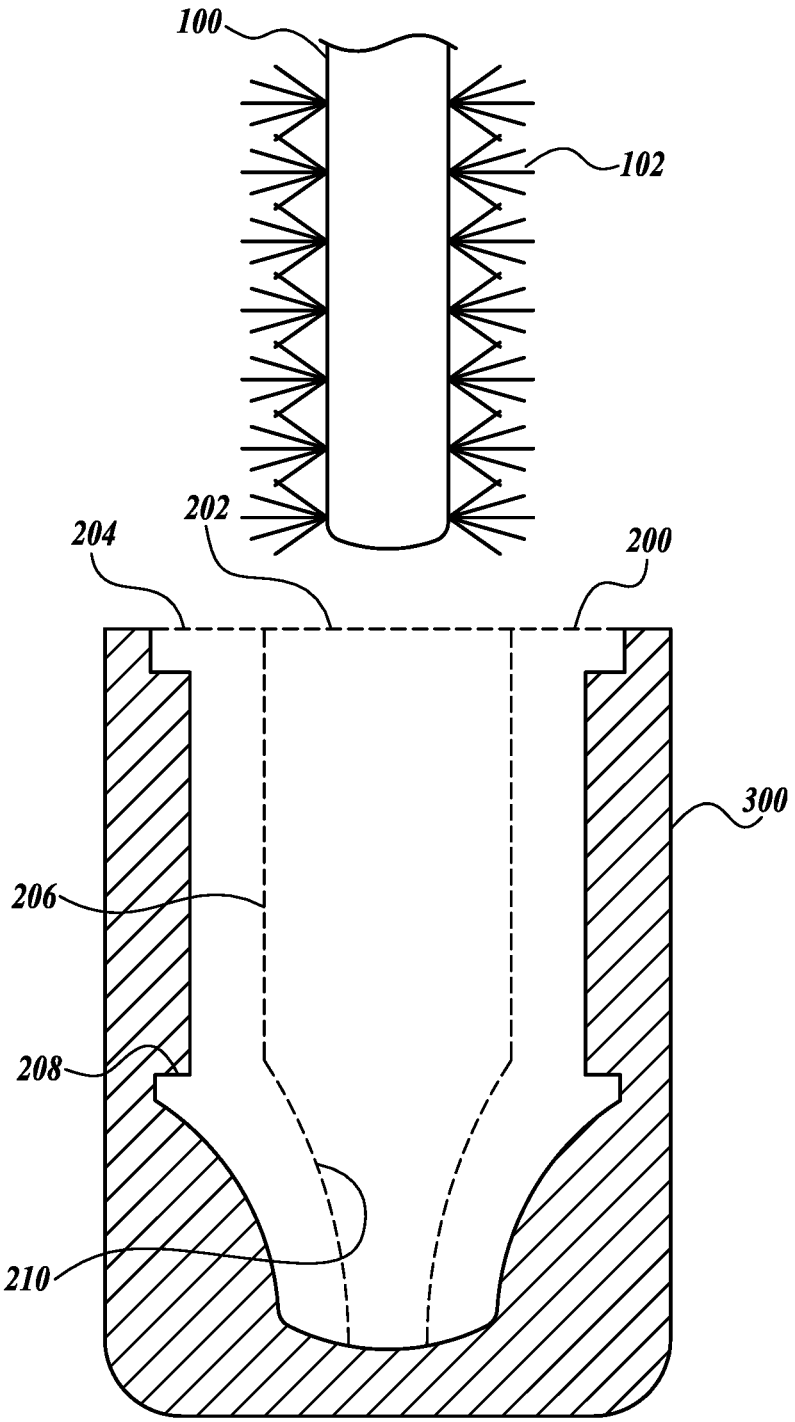
FIG. 1 is a schematic illustration of a vial containing a wiper in accordance with an embodiment.
Figure 3:
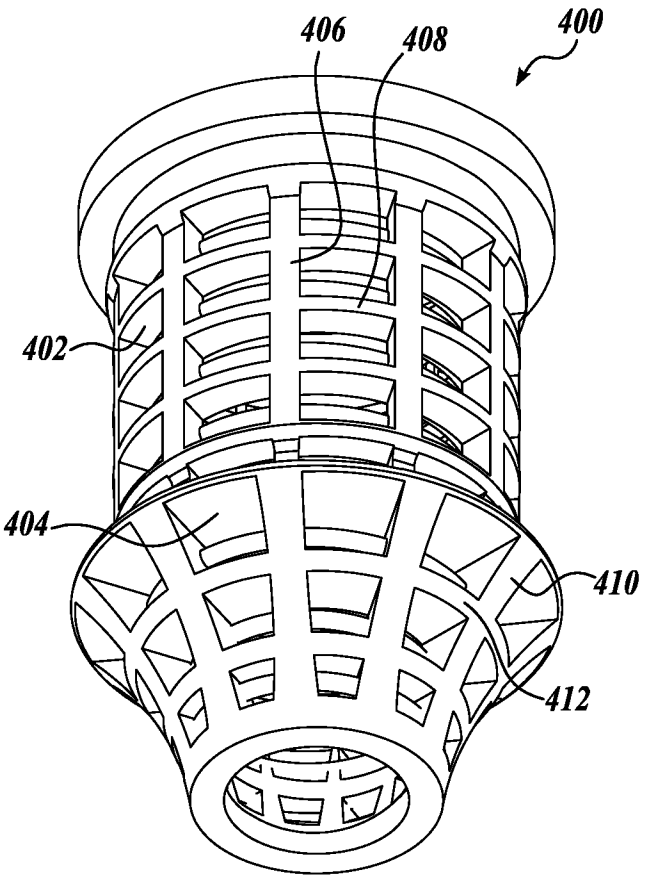
FIG. 3 is a diagrammatical bottom view illustration of the wiper of FIG. 2.
Figure 2:
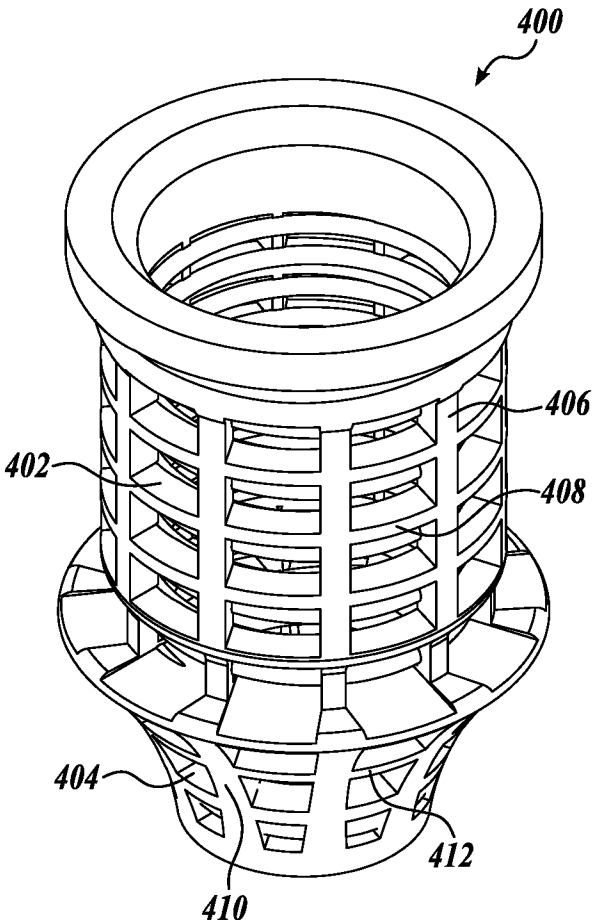
FIG. 2 is a diagrammatical top view illustration of a wiper in accordance with an embodiment.
Figure 5:
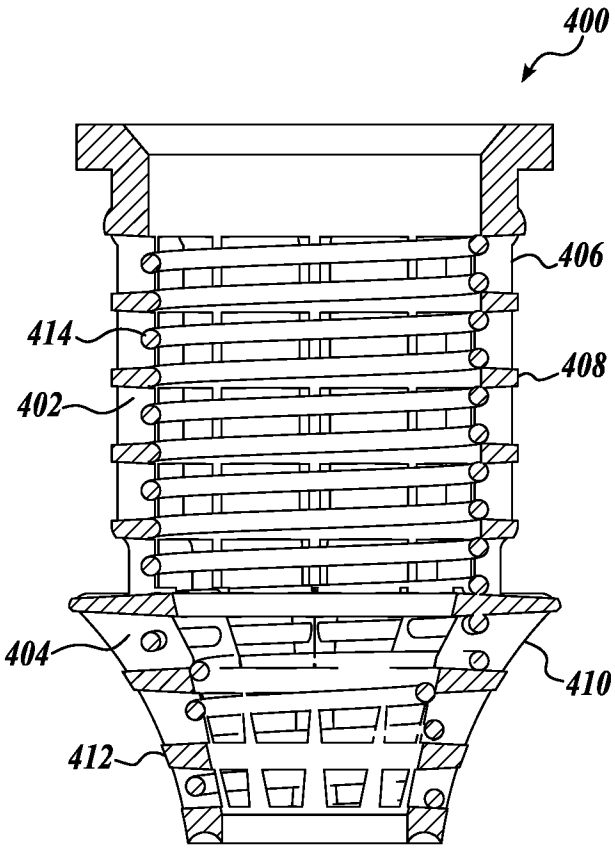
FIG. 5 is a diagrammatical cross-sectional view illustration of the wiper of FIG. 4.
Figure 4:
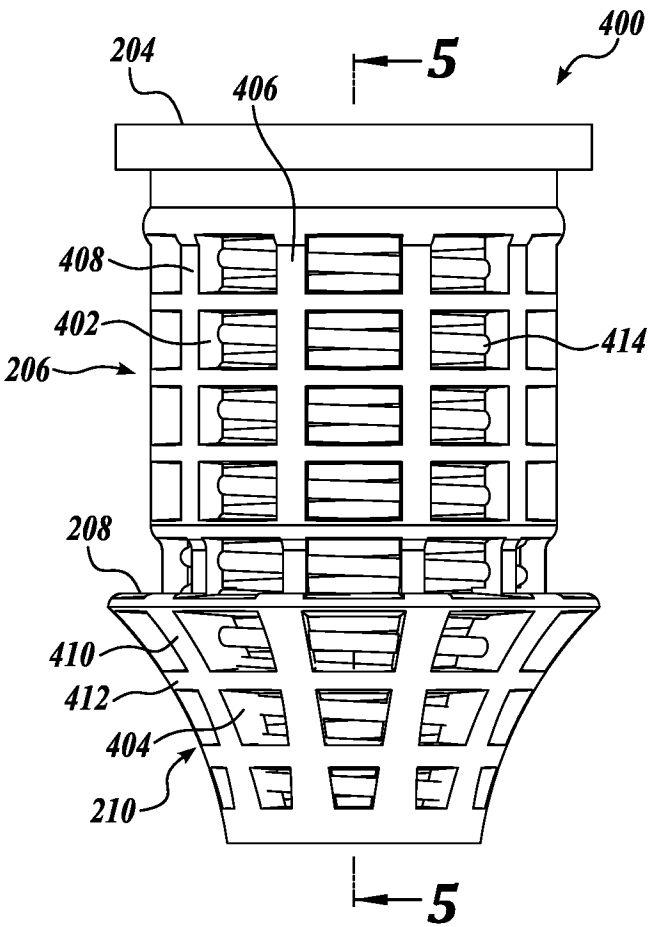
FIG. 4 is a diagrammatical side view illustration of the wiper of FIG. 2.
Figure 7:
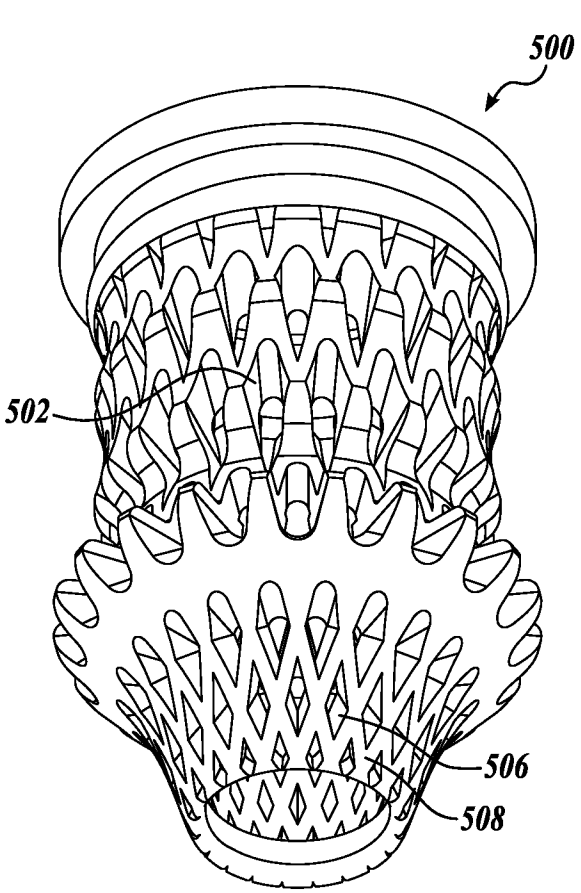
FIG. 7 is a diagrammatical bottom view illustration of the wiper of FIG. 6.
Figure 6:
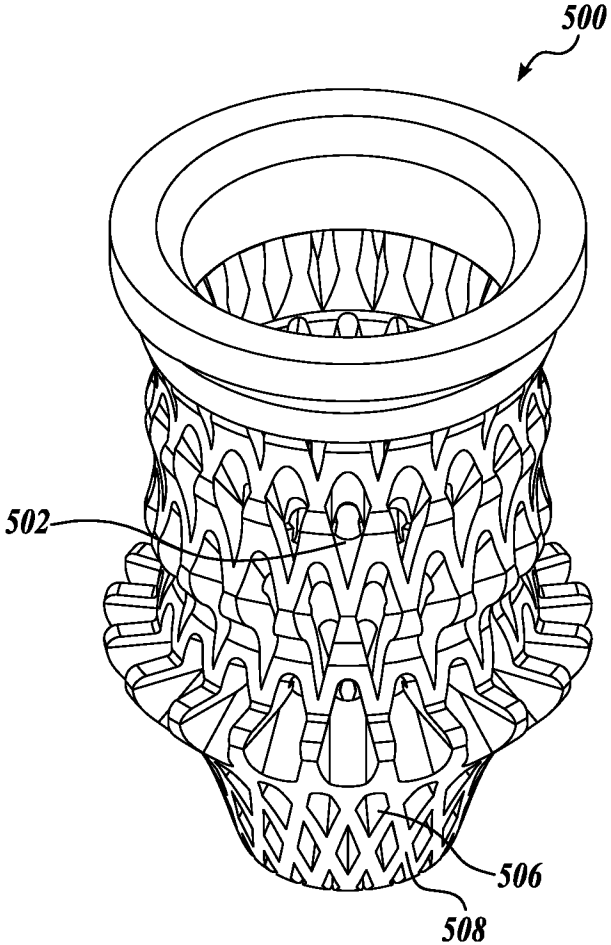
FIG. 6 is a diagrammatical top view illustration of a wiper in accordance with an embodiment.
Figure 9:
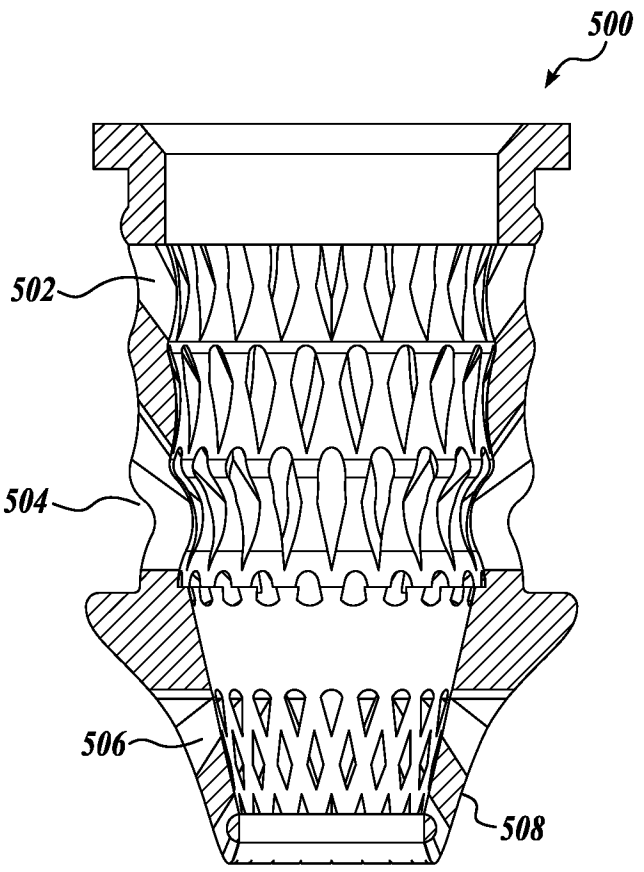
FIG. 9 is a diagrammatical cross-sectional view illustration of the wiper of FIG. 8.
Figure 8:
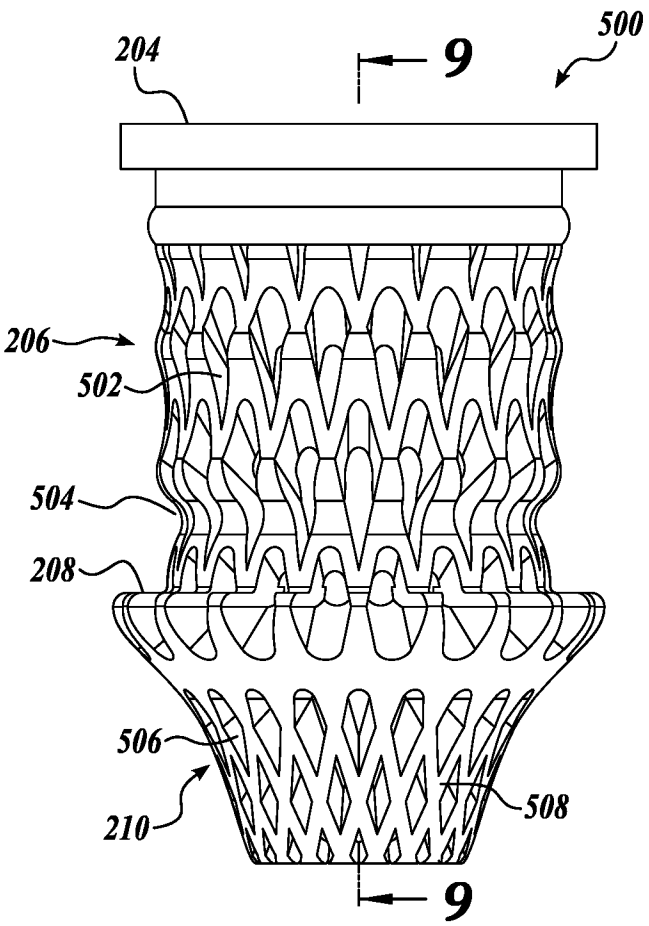
FIG. 8 is a diagrammatical side view illustration of the wiper of FIG. 6.
Figure 11:
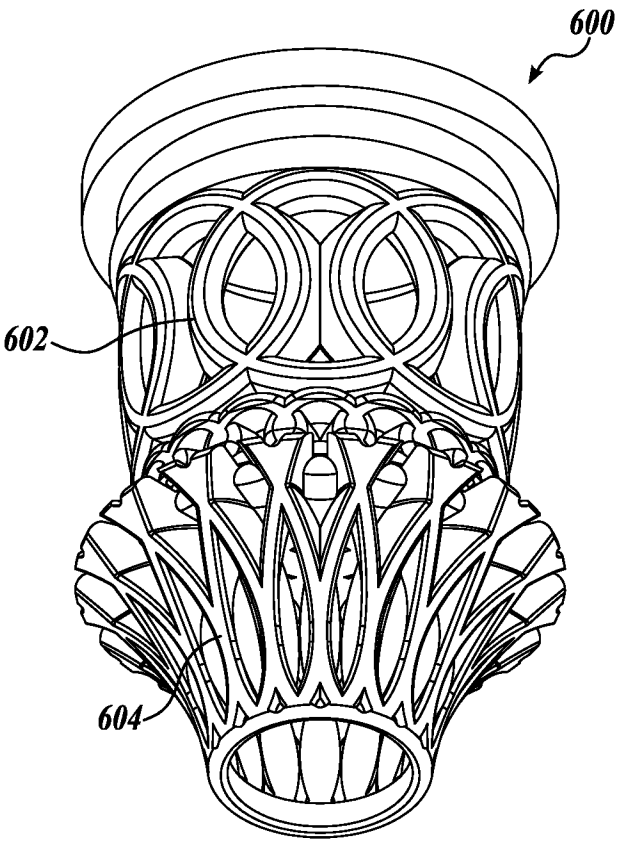
FIG. 11 is a diagrammatical bottom view illustration of the wiper of FIG. 10.
Figure 10:
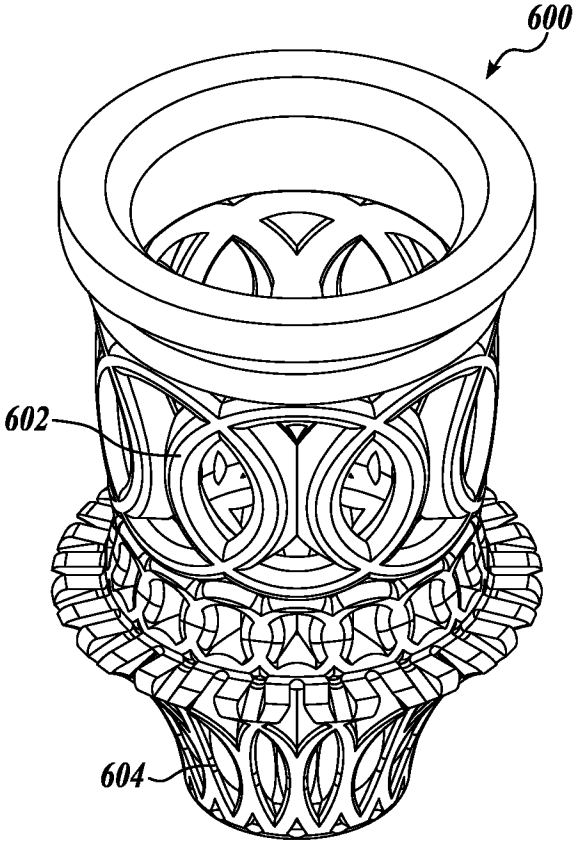
FIG. 10 is a diagrammatical top view illustration of a wiper in accordance with an embodiment.
Figure 13:
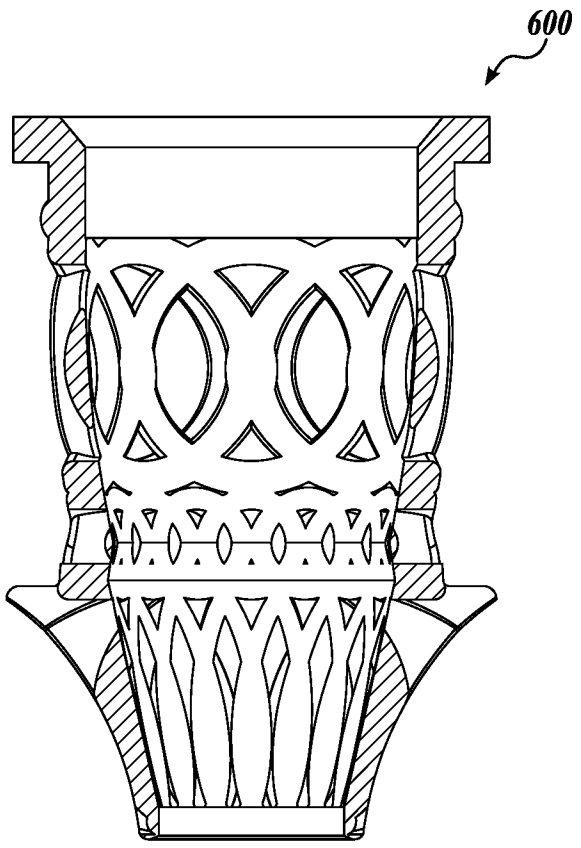
FIG. 13 is a diagrammatical cross-sectional view illustration of the wiper of FIG. 12.
Figure 12:
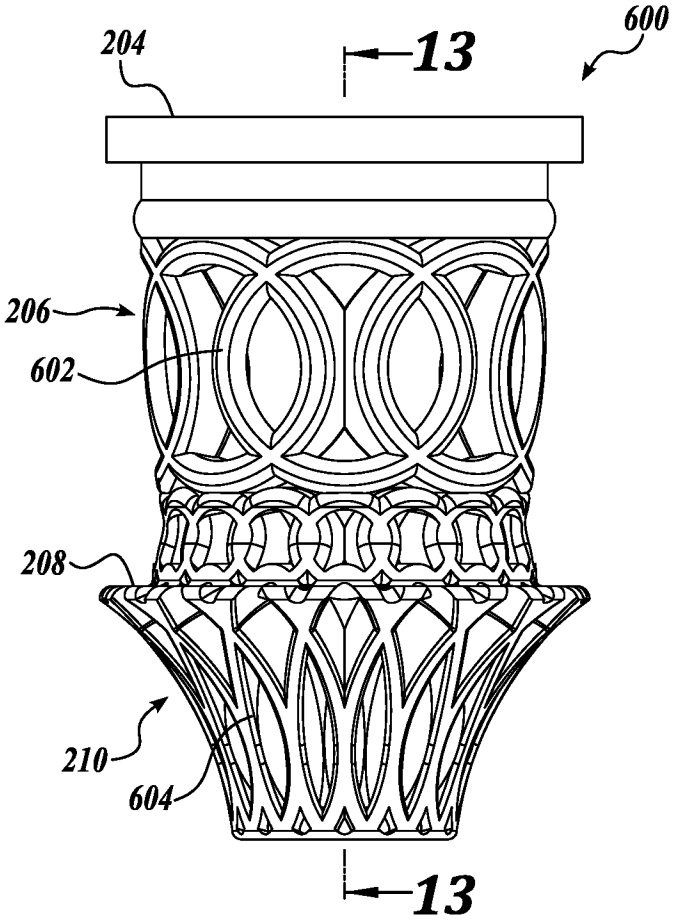
FIG. 12 is a diagrammatical side view illustration of the wiper of FIG. 10.
Figure 15:
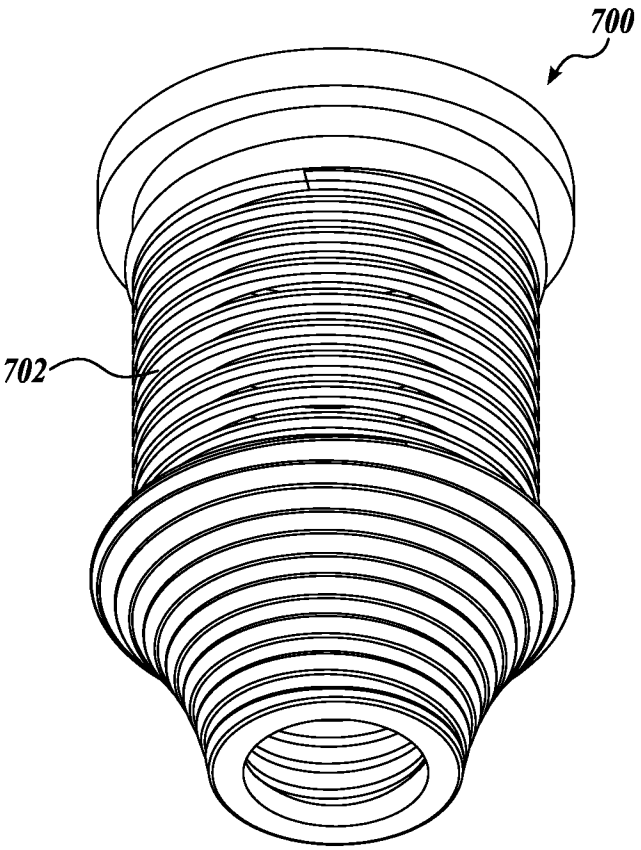
FIG. 15 is a diagrammatical bottom view illustration of the wiper of FIG. 14.
Figure 14:
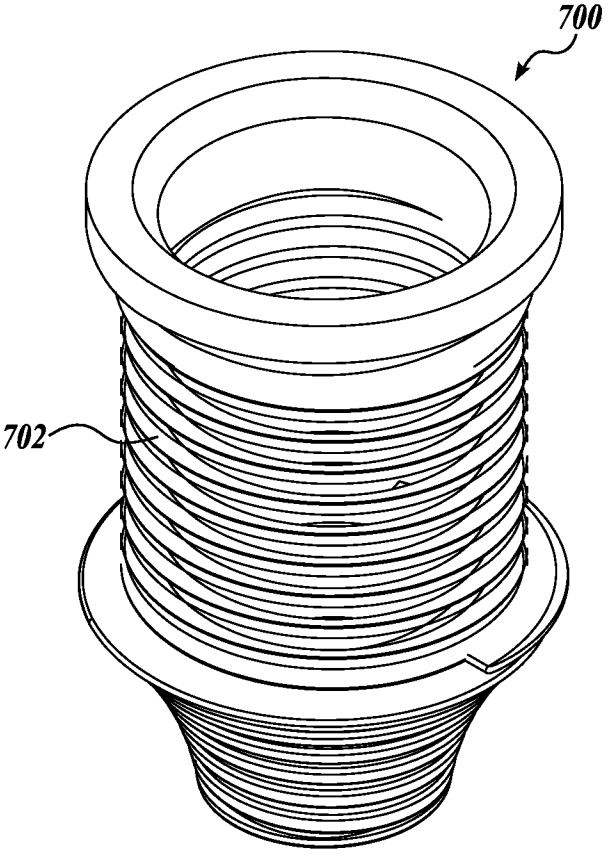
FIG. 14 is a diagrammatical top view illustration of a wiper in accordance with an embodiment.
Figure 17:
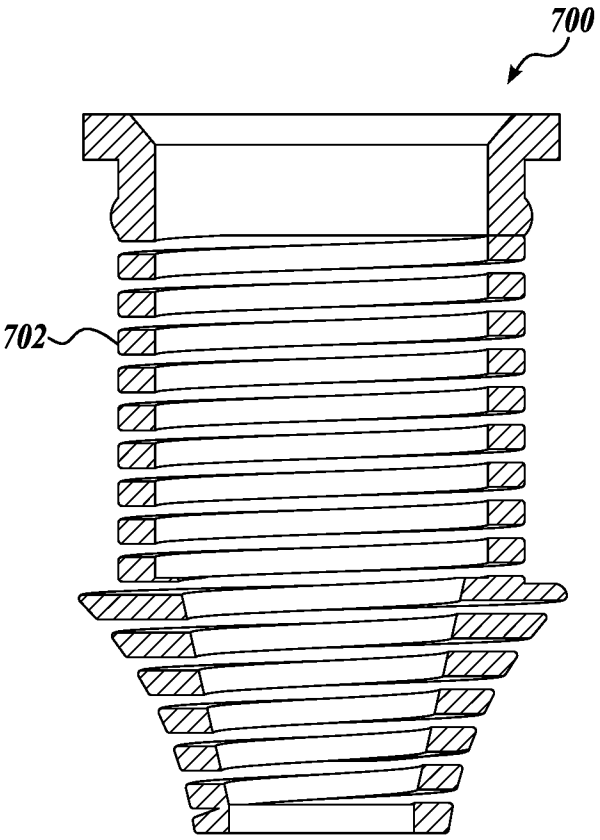
FIG. 17 is a diagrammatical cross-sectional view illustration of the wiper of FIG. 16.
Figure 16:
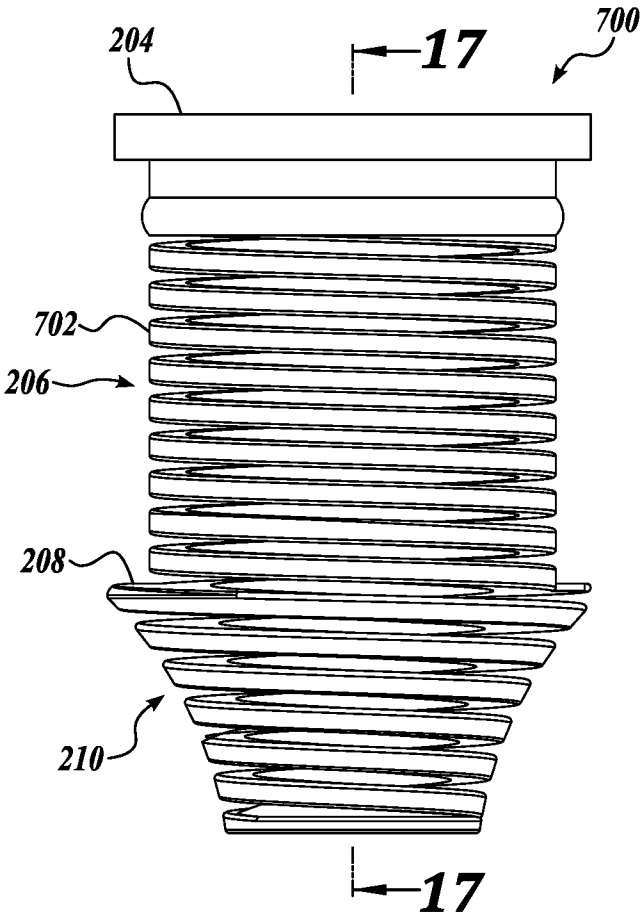
FIG. 16 is a diagrammatical side view illustration of the wiper of FIG. 14.
Figure 19:
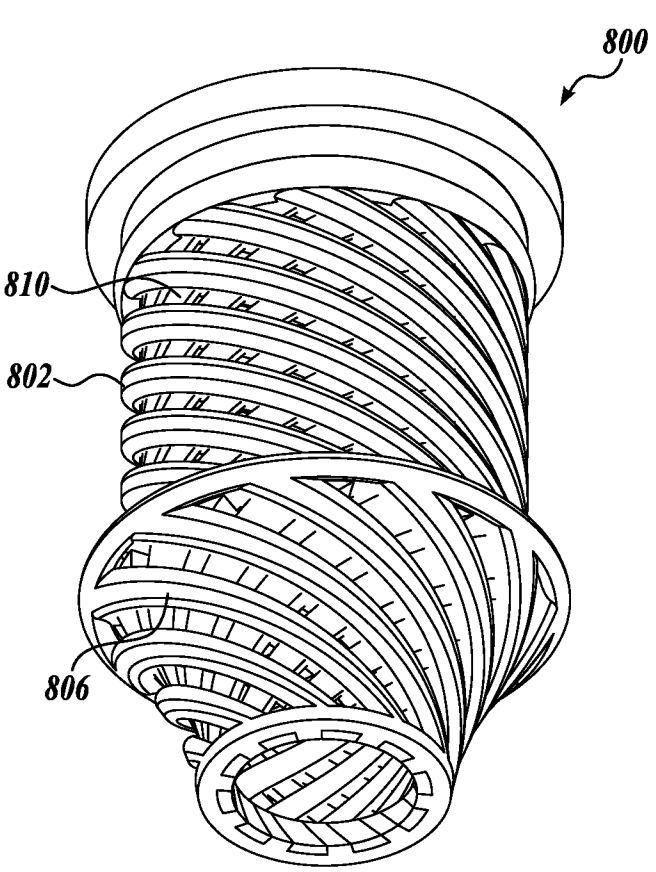
FIG. 19 is a diagrammatical bottom view illustration of the wiper of FIG. 18.
Figure 18:
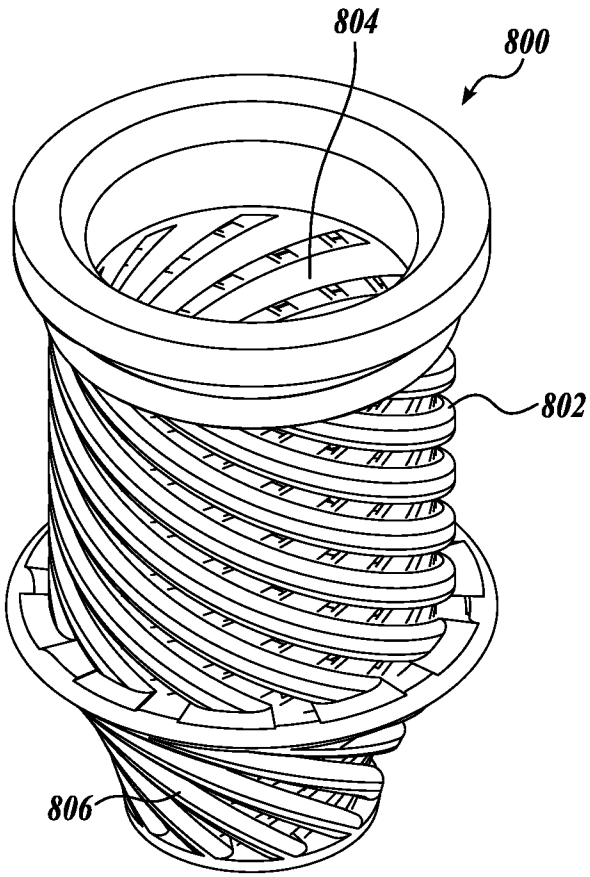
FIG. 18 is a diagrammatical top view illustration of a wiper in accordance with an embodiment.
Figure 21:
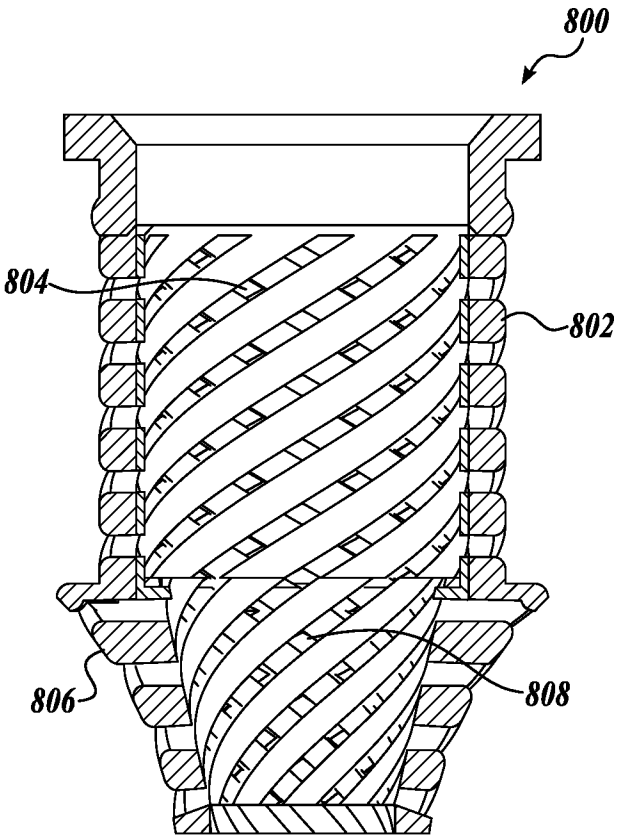
FIG. 21 is a diagrammatical cross-sectional view illustration of the wiper of FIG. 20.
Figure 20:
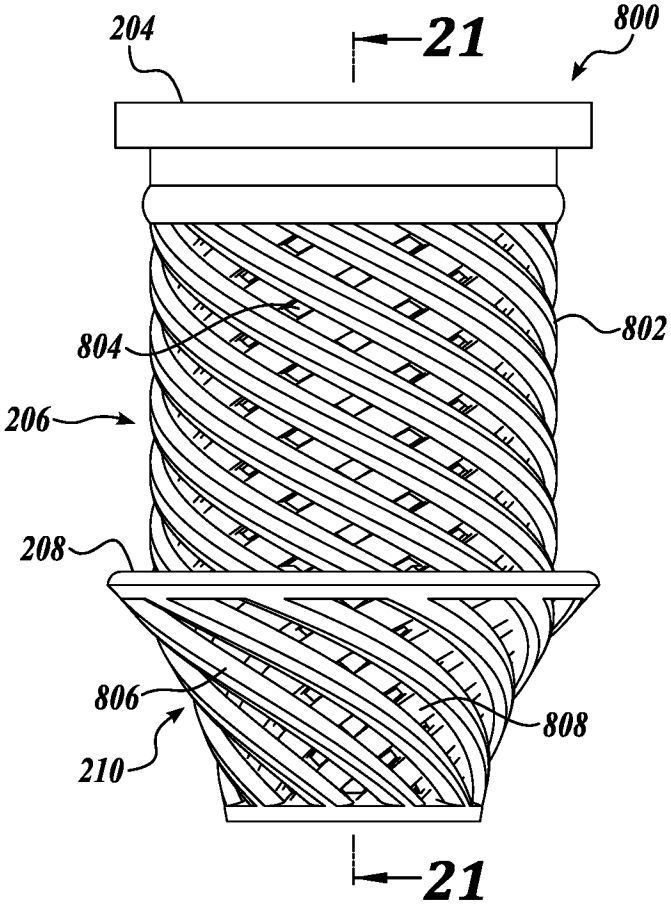
FIG. 20 is a diagrammatical side view illustration of the wiper of FIG. 18.

FIG. 1 is an illustration of a vial 300 including a wiper 200 inserted on the inside of the vial 300. The vial 300 and wiper 200, for example, can be used as a container for mascara cosmetic. Cosmetic vial 300 can be a generally cylindrical container with an open top and a closed bottom.

A mascara formulation for enhancing the look of eyelashes includes ingredients selected from the following, a pigment, such as iron oxide or carbon black, polymer coatings; one or more preservatives; and thickening waxes or oils, such as, lanolin, mineral oil, castor oil, and carnauba wax.

Cosmetic vials generally come with an applicator 100, having brush bristles 102 on the end of the applicator 100. The applicator 100 can be attached to the vial 300 to prevent desiccation of the formulation. For example, the top of the vial can have threads and the bottom of the applicator 100 can have matching threads to thereby attach the applicator to the vial in a removable manner. To load cosmetic formulation onto the applicator 100, the applicator 100 is inserted into the vial 300. The brush bristles 102 make contact with the interior side of the wiper 200, thereby transferring cosmetic to the brush bristles 102.

In accordance with this disclosure, the wiper 200 that fits inside the vial 300 can be provided according to different shapes that are advantageous from a performance point of view. Wiper 200 shapes according to this disclosure can have one or more advantages. For example, the wipers are designed to fully clean mascara brush bristles while maintaining a good load on the brush core to provide excellent separation and volume. Wipers according to this disclosure may also provide improved sensoriality upon extraction of the applicator, such as a bouncy feel. Wipers according to this disclosure may also enhance brush loading for a high volume mascara brush application. In one embodiment, the wiper 200 is replaceable with a wiper of a different configuration. For example, described herein with respect to FIGS. 2 to 21 are a plurality of differently configured latticed wipers, any one of which that can fit within the vial 300 and be used as the wiper 200.

In accordance with this disclosure, a wiper includes a lattice network formed from stringers arranged in a variety of shapes. The lattice wiper is made from elastic materials that can expand and contract upon extraction of the applicator 100. The lattice wiper can also hold cosmetic formula, such as mascara, in the various crevices and cavities that provides further loading to the applicator 100 upon extraction.

In one embodiment, the wiper 200 will be constructed by 3-D printing methods such that the wiper 200 includes openings along the length and circumference of the wiper 200. The openings will extend from the interior of the wiper 200 to the exterior of the wiper 200. The openings will be defined by the lattice network formed from the stringers that can be configured in a variety of angles, circles, spirals, rectangles, squares, and the like. In one embodiment, the wiper 200 may be formed from elastomeric materials to deform under pressure. In one embodiment, the wiper 200 may be formed from harder semi-rigid plastics.

A wiper 200 will generally include a cylindrical section 206 connected to a hyperbolic cone section 210. The cylindrical section 206 and the hyperbolic cone section 210 are concentric and lie on the same central axis. The cylindrical section 206 and the hyperbolic cone section 210 are arranged sequentially, meaning that the cylindrical section 206 ends wherein the hyperbolic cone section 210. A opening 202 is extends from one end of the cylindrical section on top through the hyperbolic cone section on the bottom.

The hyperbolic cone section 210 has a wide base at the second flange 208 which then tapers on all sides into a narrower apex. The hyperbolic cone section 210 has generally circular boundaries on the interior and exterior with a diameter that gradually decreases from the base to the apex. The central interior of the hyperbolic cone section 210 is devoid of material creating the hollow space 202 extending along the axial center throughout the whole of the hyperbolic cone section 210. The reduction on the interior and the exterior of the hyperbolic cone section 210 can follow a hyperbolic curve, or any other curve whose rate of decrease is not constant. However, in one embodiment, the rate of diameter decrease can be constant, e.g., a proportional or linear decrease. Decreasing diameter refers to a direction from the base to the apex. However, increasing diameter can be used to refer to the direction from the apex to the base.

The cylindrical section 206 is defined by generally constant inner and outer diameters. The central interior of the cylindrical section 206 is devoid of material creating the hollow space 202 extending along the axial center throughout the whole of the cylindrical section. The cylindrical section 206 has a disk-shaped flange 204 at the top end. At the opposite end from the first flange 204, the cylindrical section 206 ends in a second flared flange 208. The second flange 208 may have a flat upper surface and a concave lower surface, such that the flat upper surface can abut a corresponding flat surface of the vial 300 to resist from being pulled out from the vial. The first flange 204 may have the lower flat surface rest on a corresponding flat surface of the vial 300 to resist from being pushed further into the vial 300.

The second flange 208 is at the transition from the cylindrical section 206 of the vial to the hyperbolic cone section 210. The hyperbolic cone section 210 can be defined by an inner hyperbolic curve and an outer hyperbolic curve. The axial hollow space 202 from the cylindrical section 206 continues throughout the axial length of the hyperbolic cone section 210 as well. The inner diameter of the hyperbolic cone section 210 is smallest at the furthest end from the second flange 208, while the largest inner diameter can generally coincide axial-wise with the flat side of the second flange 208. The inner diameter of the cylindrical cone section 206 transitions to the inner diameter of the hyperbolic cone section 210. The outer diameter of the cylindrical section 210 increases to form the top flat side of the second flange 206, then becomes constant to define the outer thickness of the second flange 208, and then continues in a decreasing manner to form the outer diameter of the hyperbolic curve section 210. The outer diameter of the hyperbolic cone section 210 is smallest at the furthest end from the second flange 208, while the outer diameter reaches a maximum corresponding to the radial dimension of the second flange 208. The concave lower surface of the second flange 208 is the extension of the outer hyperbolic curve of the hyperbolic cone section 210. The thickness of the hyperbolic cone section 210 does not have to be constant. In one embodiment, the wall thickness of the hyperbolic cone section 210 is smallest at the furthest end from the second flange 208 and largest where the outer hyperbolic curves reaches the second flange 208.

In one embodiment, the hyperbolic cone section 210 is defined by circumferential sides that bow inward, where the greatest deflection is at the base at the second flange 208 with progressively lesser deflection from the base to the end. In one embodiment, the hyperbolic cone section 210 can be defined as a "three-dimensional cusp."

In one embodiment, the wipers described herein are made from a flexible material, such as elastomers. In one embodiment, the wipers are made by 3-D printing techniques or additive manufacturing. 3-D printing builds structures by sequential deposition of very thin layers on top of each other. 3-D printing is based on a software model of the part to be created. The software can slice the model into very thin layers from which the physical part is constructed one layer at a time. Each slice of the programmed model depicts areas where material is added and the areas where material is absent. To add material, a 3-D printer ejects material through one or more nozzles precisely in the area according to the software model. 3-D printing can start at the first flange 204 and then, each subsequent layer can add to the height of the flange 204 until the flange 204 is completed. Then, material is deposited only in selected areas of the circumference of the cylindrical section and hyperbolic cone section according to the pre-programmed model to build the lattice type structures. "Stringers" that make up the lattice structure can have cross-sectional shapes, including, squares, rectangles, triangles, polygons, circles, ellipse, or any other geometric shape. 3-D printing can result in a single monolithic part made from stringers integrally joined to each other without the use of adhesives or welding or mechanical fasteners.

Monolithic is used to signify a part that is entirely a single unitary part as contrasted with an assembly of parts. In an embodiment, monolithic parts are made by additive manufacturing, such as three dimensional printing. However, in other embodiments, monolithic parts are made by subtractive manufacturing. Subtractive manufacturing are processes used in making three dimensional parts by first starting with a blank part, and then, cutting away material to eventually result in the finished product. Either additive or subtractive manufacturing processes can be used to make monolithic parts. Monolithic parts can also be made by molding or casting and the like, which are processes using a melted or fluid material poured into a mold. The melted or fluid material then solidifies through cooling or chemical reaction through curing. A monolithic part can also have a consistent or uniform distribution of material throughout the whole part, where an assembly suffers from inconsistencies and nonuniformity at the joints of two or more subparts.

FIGS. 2 to 5 illustrate an embodiment of a wiper 400 having the above-described first and second flanges 204, 208, and the cylindrical and hyperbolic cone sections 206, 210. In this embodiment, the openings 402 are square in the cylindrical section 206 by having vertical stringers 406 and circumferential stringers 408, such that the vertical stringers 406 and the circumferential stringers 408 intersect each other at right angles. The openings 404 in the hyperbolic cone section 210 are trapezoidal caused by the decreasing diameter in this section. The vertical stringers 410 in the hyperbolic cone section 210 are also inwardly bowed according to the hyperbolic cone section 410, and the circumferential stringers 412 increase in diameter corresponding to the shape of the hyperbolic cone section 210. A continuous spiral stringer 414 is placed on the inside of wiper 400 that follows the inner diameters of cylindrical and hyperbolic cone sections 206, 210. The spiral stringer 414 can be either a right-hand spiral or a left hand spiral.

FIGS. 6 to 9 illustrate an embodiment of a wiper 500 having the above-described first and second flanges 204, 208, and the cylindrical and hyperbolic cone sections 206, 210. The openings 502 in the cylindrical section 206 include "tear drop" curves, a curve have a circular shape on one end and coming to a point at the opposite end. The exterior of the cylindrical section 206 marked by exterior circumferential undulations 504 caused by a variation in the outer and inner diameter along the axial direction. The openings 502 are projected downward through the thickness of the wiper 400, such that the same opening on the exterior comes out at a lower axial position on the interior. The hyperbolic cone section 210 has "tear drop" curve openings 506 on a first top row, and diamond openings 508 in the second and third rows. The hyperbolic cone section 210 decreases in diameter from the second flange 208 to the end of the wiper 400 without any increases in the diameter or circumferential undulations. The openings 506 in the hyperbolic cone section 210 are projected upward through the thickness of the wiper 400, such that the same opening on the exterior comes out at a higher axial position on the interior.

FIGS. 10 to 13 illustrate an embodiment of a wiper 600 having the above-described first and second flanges 204, 208, and the cylindrical and hyperbolic cone sections 206, 210. The stringers 602 in this embodiment are arranged in the cylindrical section 206 into large diameter circles from the bottom of the first flange 204 and smaller diameter circles on the bottom of the cylindrical section 206 above the second flange 208. Any large circle intersects the adjacent large circles on the left and right at two points, while circles that are separated by one large circle touch each other. The stringers 604 in the hyperbolic cone section 210 are arranged into a "fish curve," the Tschirnhausen Cubic equation, having a flattened lobe and a chevron on the top of the lobe.

FIGS. 14 to 17 illustrate an embodiment of a wiper 700 having the above-described first and second flanges 204, 208, and the cylindrical and hyperbolic cone sections 206, 210. The stringer 702 in this embodiment can be a continuous spiral extending in the cylindrical section 206 which continues into the hyperbolic cone section 210 to the end of the wiper 700. The spiral can be a right-hand spiral or a left hand spiral. The openings in the wiper 700 becomes a continuous opening between the adjacent spiral windings.

FIGS. 18 to 21 illustrate an embodiment of a wiper 800 having the above-described first and second flanges 204, 208, and the cylindrical and hyperbolic cone sections 206, 210. The stringers in the cylindrical section 206 include a plurality of left hand stringer spirals 802 in the cylindrical section 206 on the exterior of the cylindrical section 206 and a plurality of right hand stringer spirals 804 on the interior of the cylindrical section 206, wherein both the left hand stringers 802 and the right hand stringers 804 extend from the bottom of the first flange 204 to the top of the second flange 208. The stringers in the hyperbolic cone section 210 include a plurality of left hand stringer spirals 806 on the exterior of the hyperbolic cone section 210 and a plurality of right hand stringer spirals 808 on the interior of the hyperbolic cone section 210, wherein both the left hand stringers 806 and the right hand stringers 808 extend from the bottom of the second flange 204 to the end of the wiper 800. In one embodiment, for both the cylindrical section 206 and the hyperbolic cone section 210, the left hand and right hand spirals will cross each other at greater than 90 degrees. The openings 810 in the wiper 800 therefore appear as diamond shapes.

In an embodiment, a wiper for a cosmetic vial is a monolithic part having a cylindrical section and a cone section concentrically and sequentially arranged with respect to the cylindrical section, wherein the cylindrical section and the cone section have a central interior hollow space along an axial center, and wherein the cylindrical and the cone sections are formed from stringers arranged into a lattice with openings extending from the interior to the exterior of the cylindrical section and the cone section.

In an embodiment, a wiper for a cosmetic vial is or comprises a monolithic part having a cylindrical section and a cone section concentrically and sequentially arranged with respect to the cylindrical section, wherein the cylindrical section and the cone section have a central interior hollow space along an axial center, and wherein the cylindrical and the cone sections are formed from stringers arranged into a lattice with openings extending from the interior to the exterior of the cylindrical section and the cone section.

In an embodiment, the wiper comprises a first flange on an end of the wiper.

In an embodiment, the wiper comprises a second flange at a junction between the cylindrical section and the cone section.

In an embodiment, the wiper comprises the exterior sides of the cone section bow inwardly.

In an embodiment, the monolithic part is an elastomer.

In an embodiment, the wiper comprises a cosmetic dispersed in the lattice.

In an embodiment, the cosmetic is mascara.

In an embodiment, a method of making a cosmetic wiper comprises building an elastomer monolithic part having a cylindrical section and a cone section concentrically and sequentially arranged by repeated deposition of an elastomer material layer, each layer is determined by a programmed model of the part.

In an embodiment, a cosmetic vial comprises the wiper inside of a vial, wherein a cosmetic is dispersed on the wiper; and an applicator is removably connected to the vial.

In an embodiment, the cosmetic is mascara.

In an embodiment, the applicator comprises brush bristles.

In an embodiment, wherein the applicator rests within the hollow spaces of the cylindrical section and the cone section, and brush bristles on the applicator make contact with the wiper.

In an embodiment, a cosmetic vial comprises a plurality of the wipers, and an applicator is removably connected to the vial, wherein each one of the plurality of wipers is configured to fit within the vial.

While illustrative embodiments have been illustrated and described, it will be appreciated that various changes can be made therein without departing from the spirit and scope of the invention.

The embodiments of the invention in which an exclusive property or privilege is claimed are defined as follows:

1. A wiper for a cosmetic vial, comprising:

a monolithic part having a cylindrical section and a cone section concentrically and sequentially arranged, wherein the cylindrical section and the cone section have a central interior hollow space along an axial center, and wherein the cylindrical and the cone sections are formed from stringers arranged into a lattice with openings extending from the interior to the exterior of the cylindrical section and the cone section, wherein the cone section is defined by circumferential sides that bow inward, where the greatest deflection is at a base of the cone section with progressively lesser deflection from the base to an end of the cone section.

2. The wiper of claim 1, comprising a first flange on an end of the wiper.

3. The wiper of claim 1, comprising a second flange at a junction between the cylindrical section and the cone section.

4. The wiper of claim 1, wherein the exterior sides of the cone section bow inwardly.

5. The wiper of claim 1, wherein the monolithic part is an elastomer.

6. The wiper of claim 1, comprising a cosmetic dispersed in the lattice.

7. The wiper of claim 6, wherein the cosmetic is mascara.

8. A method of making a cosmetic wiper, comprising:

building an elastomer monolithic part having a cylindrical section and a cone section concentrically and sequentially arranged by repeated deposition of an elastomer material layer, each layer is determined by a programmed model of the part, wherein the elastomer material is deposited in a lattice structure with openings.

9. A cosmetic vial, comprising:

the wiper of claim 1 inside of a vial, wherein a cosmetic is dispersed on the wiper; and an applicator is removably connected to the vial.

10. The cosmetic vial of claim 9, wherein the cosmetic is mascara.

11. The cosmetic vial of claim 9, wherein the applicator comprises brush bristles.

12. The cosmetic vial of claim 9, wherein the applicator rests within the hollow spaces of the cylindrical section and the cone section, and brush bristles on the applicator make contact with the wiper.

* * * * *